US008133067B2

(12) United States Patent
Tsai et al.

(10) Patent No.: US 8,133,067 B2
(45) Date of Patent: Mar. 13, 2012

(54) ELECTRICAL CONNECTOR WITH LOCKING ENGAGEMENT BETWEEN AN ACTUATOR AND AN INSULATIVE HOUSING

(75) Inventors: Tzu-Ching Tsai, Tu-Cheng (TW); Xiao-Dong Wang, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 115 days.

(21) Appl. No.: 12/778,963

(22) Filed: May 12, 2010

(65) Prior Publication Data

US 2011/0111615 A1 May 12, 2011

(51) Int. Cl.
*H01R 13/15* (2006.01)

(52) U.S. Cl. ..... 439/260

(58) Field of Classification Search ..... 361/809; 439/260, 495, 267, 328, 357, 358
See application file for complete search history.

(56) References Cited

U.S. PATENT DOCUMENTS

| | | | | |
|---|---|---|---|---|
| 6,162,083 | A * | 12/2000 | Seto | 439/328 |
| 7,134,891 | B2 | 11/2006 | Kayama | |
| 7,361,042 | B2 * | 4/2008 | Hashimoto et al. | 439/260 |
| 7,361,048 | B2 * | 4/2008 | Shimada | 439/492 |
| 7,766,694 | B2 * | 8/2010 | Tanaka et al. | 439/495 |
| 2007/0072446 | A1 * | 3/2007 | Hashimoto et al. | 439/66 |
| 2007/0076400 | A1 * | 4/2007 | Shimada | 361/809 |

* cited by examiner

*Primary Examiner* — Chandrika Prasad
(74) *Attorney, Agent, or Firm* — Andrew C. Cheng; Wei Te Chung; Ming Chieh Chang

(57) ABSTRACT

An electrical connector for connecting a flexible printed circuit board comprises an insulator, a plurality of terminals and an actuator mounting onto the insulator. The insulator comprises a top wall, a bottom wall opposite to the top wall and a pair of side wall joining with the top wall and the bottom wall thereby defining a cavity therebetween. The terminals arranged exposed into the cavity. The actuator can rotate between an opened position where the flexible printed circuit board can be inserted into the cavity and a closed position where the flexible printed circuit board can be abutted against the terminals. A post protrudes from the bottom wall. The actuator defines a locking beam for locking with the post and a through hole for receiving the post when the actuator is located at the closed position.

17 Claims, 8 Drawing Sheets

ELECTRICAL CONNECTOR WITH LOCKING ENGAGEMENT BETWEEN AN ACTUATOR AND AN INSULATIVE HOUSING

BACKGROUND OF THE INVENTION

1. Field of the Invention

The present invention relates to an electrical connector for connecting a flexible printed circuit board or a flat flexible cable (FPC), and more particularly to an electrical connector having an actuator for pressing and positioning the inserted FPC with the connector and in which an interengagement is arranged to ensure the actuator is securely retained to an insulative housing of the connector.

2. Description of the Related Art

U.S. Pat. No. 7,134,891 issued to Kayama on Nov. 14, 2006 discloses an electrical connector having an actuator for pressing an FPC downward. Referring to FIG. 1 and FIG. 2 of the Kayama '891 patent, an electrical connector is provided and comprises a main body defining a cavity between an upper wall and a lower wall thereof for receiving an end of the FPC, a plurality of terminals disposed in the main body and an actuator pivotally mounting on the main body for pressing against the FPC. A pair of posts protrude into the cavity from the lower wall of the main body for respectively mating with two holes of the FPC inserted into the cavity of the main body. So the FPC does not slide out from the electrical connector accidentally. However, the actuator may be pulled up accidentally, for example, resulted from an unexpected vibration of environment, hence, a new design which can solve the problem is required.

SUMMARY OF THE INVENTION

Accordingly, an object of the present invention is to provide an electrical connector having an actuator which can be locked to an insulative housing when it is closed to hold an FPC.

In order to achieve the object set forth, an electrical connector for connecting a flexible printed circuit board comprises an insulator, a plurality of terminals and an actuator mounting onto the insulator. The insulator comprises a top wall, a bottom wall opposite to the top wall and a pair of side wall joining with the top wall and the bottom wall thereby defining a cavity therebetween. The terminals arranged exposed into the cavity. The actuator can rotate between an opened position where the flexible printed circuit board can be inserted into the cavity and a closed position where the flexible printed circuit board can be depressed downward to abut against the terminals. A post protrudes from the bottom wall. The actuator defines a locking beam for locking with the post and a through hole for receiving the post when the actuator is located at the closed position.

Other objects, advantages and novel features of the invention will become more apparent from the following detailed description of the present embodiment when taken in conjunction with the accompanying drawings.

DETAILED DESCRIPTION OF THE INVENTION

Figure 1:
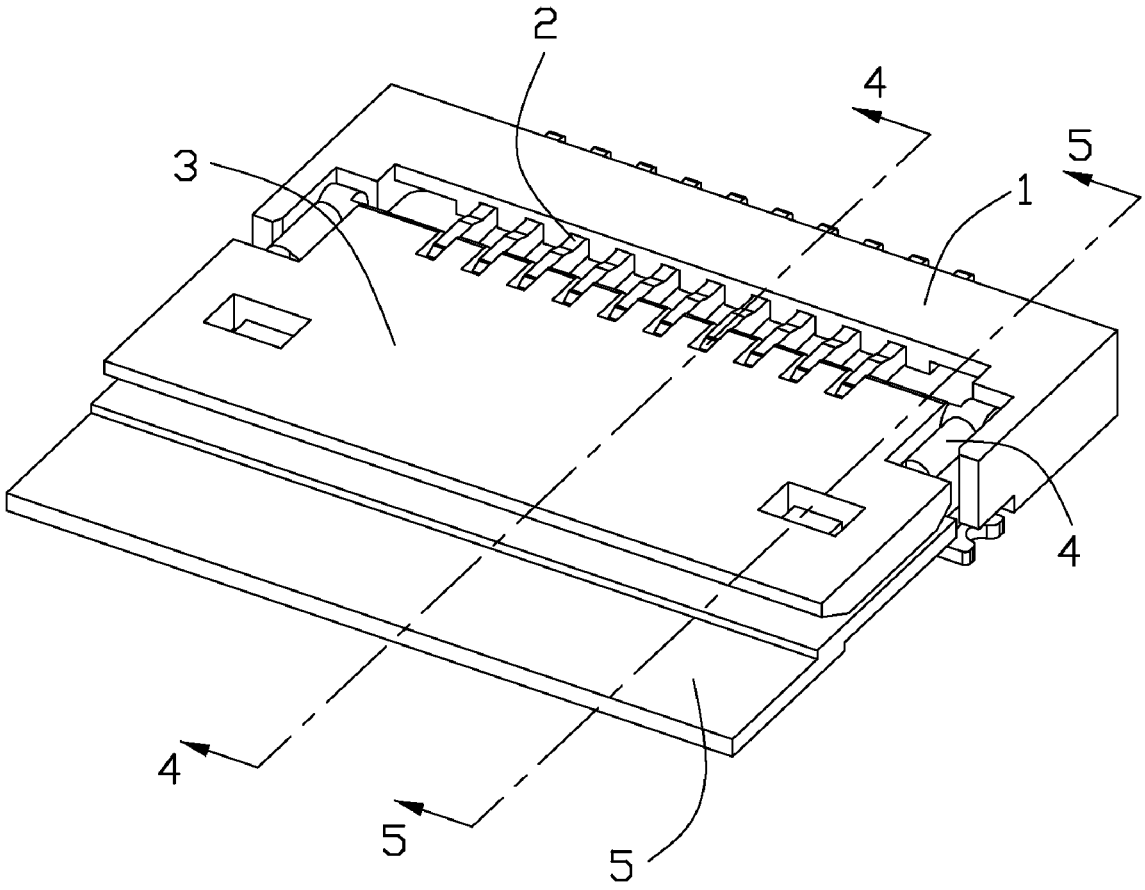
FIG. 1 is a perspective view of a first embodiment of an electrical connector in accordance with the present invention, in which the actuator is at a closed position and an FPC is inserted therein.

Reference will now be made to the drawing figures to describe a preferred embodiment of the present invention in detail. Referring to FIGS. 1 to 5, an electrical connector according to a first embodiment of the present invention is provided for electrically contacting with a flexible printed circuit board (FPC) 5.

Figure 3:
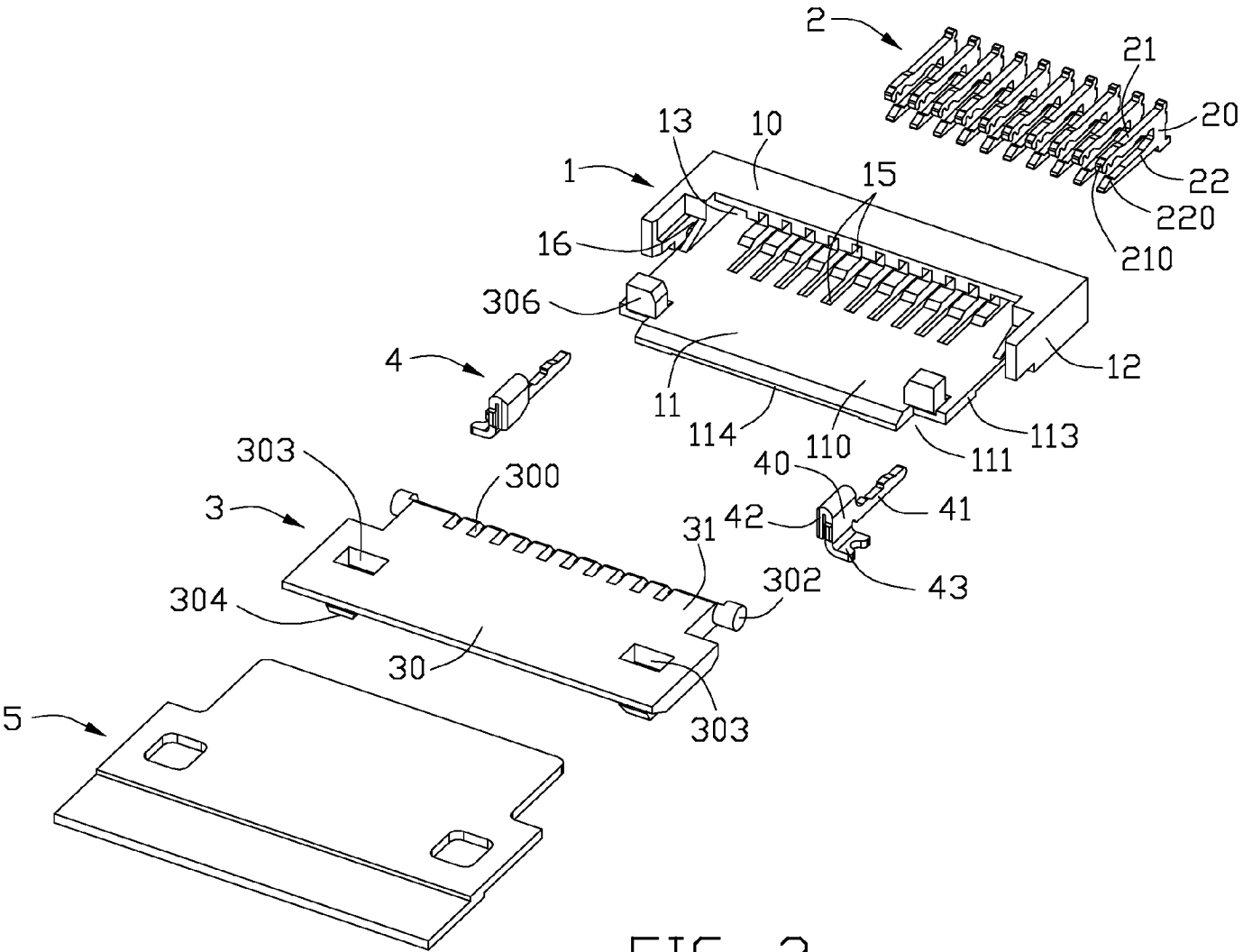
FIG. 3 is an exploded perspective view of the electrical connector shown in FIG. 1.

The electrical connector comprises an insulator or insulative housing 1, a plurality of terminals 2 disposed in the insulator 1, an actuator 3 pivotally mounting on the insulator 1 and a pair of metal pads 4. Referring to FIG. 3, the insulator 1 comprises a top wall 10, a bottom wall 11 opposite to the top wall 10, two side walls 12 joining with the top wall 10 and the bottom wall 11, the bottom wall 11 extends beyond the top wall 10 in a mating direction. A cavity 13 is formed between the top wall 10 and bottom wall 11 for receiving an end of the FPC 5. A plurality of passageways 15 are defined on the top wall 10 and the bottom wall 11 along the mating direction. Each passageway 15 extends into the cavity 13 for receiving the terminals 2. Each side wall 12 defines a groove 16 for holding the pad 4. A pair of notches 111 are defined at opposite sides of a front edge 114 of the bottom wall 11 and located in front of each side edge 113 of the bottom wall 11. A pair of posts 306 protrude upwardly from a top face 110 of the bottom wall 11 and is located behind each of the notch 111. Each post 306 projects into the notch 111 partly thereby forming a locking portion 307 thereat.

Figure 4:
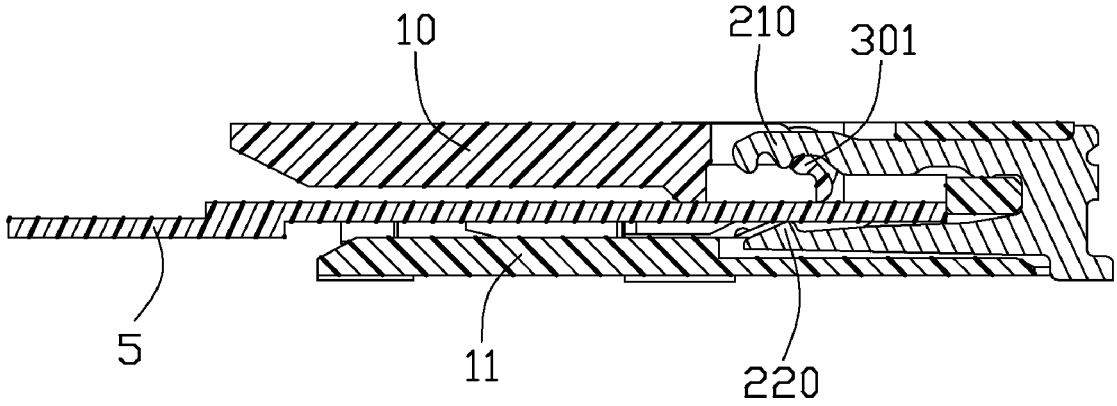
FIG. 4 is a cross-sectional view of the electrical connector shown in FIG. 1 along line 4-4.

Each of the terminals 2 has a holding portion 20 retained in the insulator 1, a pivot beam 21 and a contact beam 22 respectively extending from opposite sides of the holding portion 20 and received in the corresponding passageways 15. Each pivot beam 21 has a concave portion 210 at a free end thereof for pivotally receiving the actuator 3, which is best shown in FIG. 4. Each contact beam 22 has a contact portion 220 at a free end thereof and projects into the cavity 13 for electrically contacting with the FPC 5.

Each of the metal pads 4 has a main body 40, an arm 41 extending horizontally from the main body 40, a board portion 42 bent downward from an upper edge of the main body 40, and a solder portion 43 vertically extending from the main body 40. The metal pad 4 is securely fixed by rooting the arm 41 into the groove 16 of the insulator 1.

Figure 2:
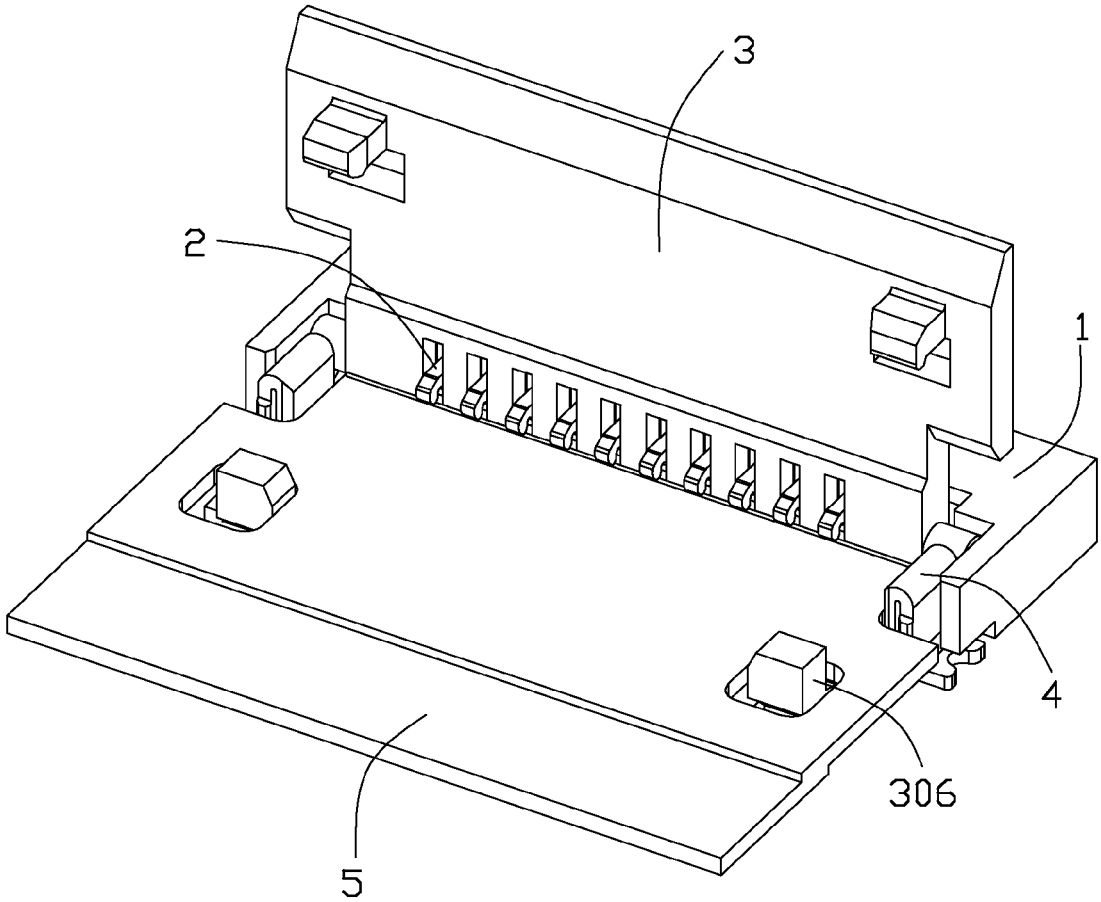
FIG. 2 is a perspective view of the electrical connector shown in FIG. 1, in which the actuator is at an opened position.
Figure 5:
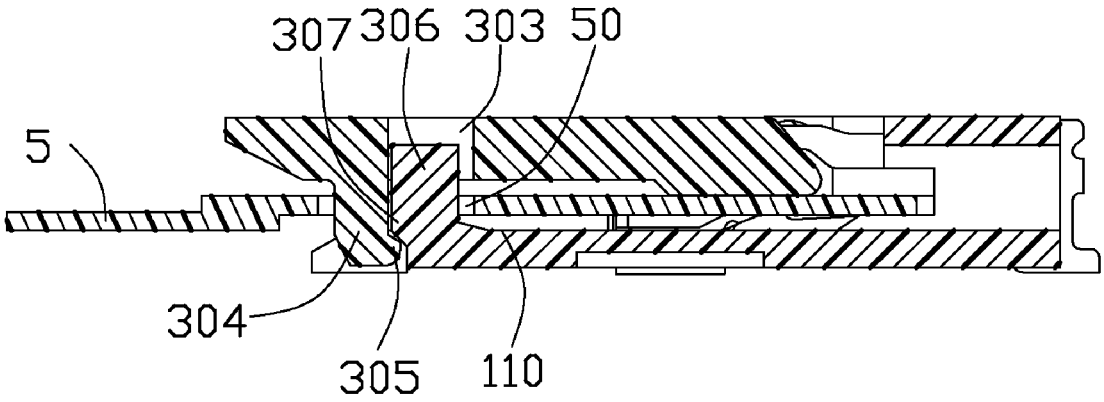
FIG. 5 is a cross-sectional view of the electrical connector shown in FIG. 1 along line 5-5.

Referring to FIG. 3 and FIG. 4, the actuator 3 has a board-like base portion 30 with a plurality of openings 300 at a front edge 31 thereof and arranged side-by-side along a transverse direction perpendicularly to the mating direction. Each opening 300 forms a shaft 301 therein for pivotally cooperation with the concave portions 210 of the terminals 2. A pair of pivots 302 protrudes upwardly along the transverse direction from two ends of the front edge 31. Each pivot 302 is supported by the arm 41 of the metal pad 4 and located between the insulator 1 and the main body 40 of the metal pad 4. Therefore the actuator 3 can rotate between an opened position where the FPC 5 can be inserted into the cavity 13 of the insulator 1 and a closed position where the FPC 5 can be abutted against the terminals 2 so as to establish the electrical connection, as shown in FIGS. 1, 2. Further more, the actuator 3 has a pair of through holes 303 at opposite side of the base portion 30 thereof for respectively receiving the posts 306 of the insulator 1. At a rear bottom side of each through hole 303, locking beam 304 projects downwardly with a hook 305 at a distal end thereof for engaging with the post 306 of the insulator 1, as shown in FIG. 5.

Referring to FIG. 2, when the actuator 3 is set at the opened position, the end of the FPC 5 is inserted into the cavity 13 of the insulator 1 and retained by the posts 306 which is being inserted into two holes 50 defined on the FPC 5. Referring to FIGS. 1, 4 and 5, when the actuator 3 is rotated to the closed position, the terminals 2 electrically contact with the FPC 5, and the posts 306 are inserted into the through holes 303 of the actuator 3, meanwhile the locking beams 304 are respectively received in the notches 111 with the hooks 305 engaging with the locking portions 307 of the posts 306. Under this condition, the actuator 3 can be held steadily by the posts 306.

Figure 6:
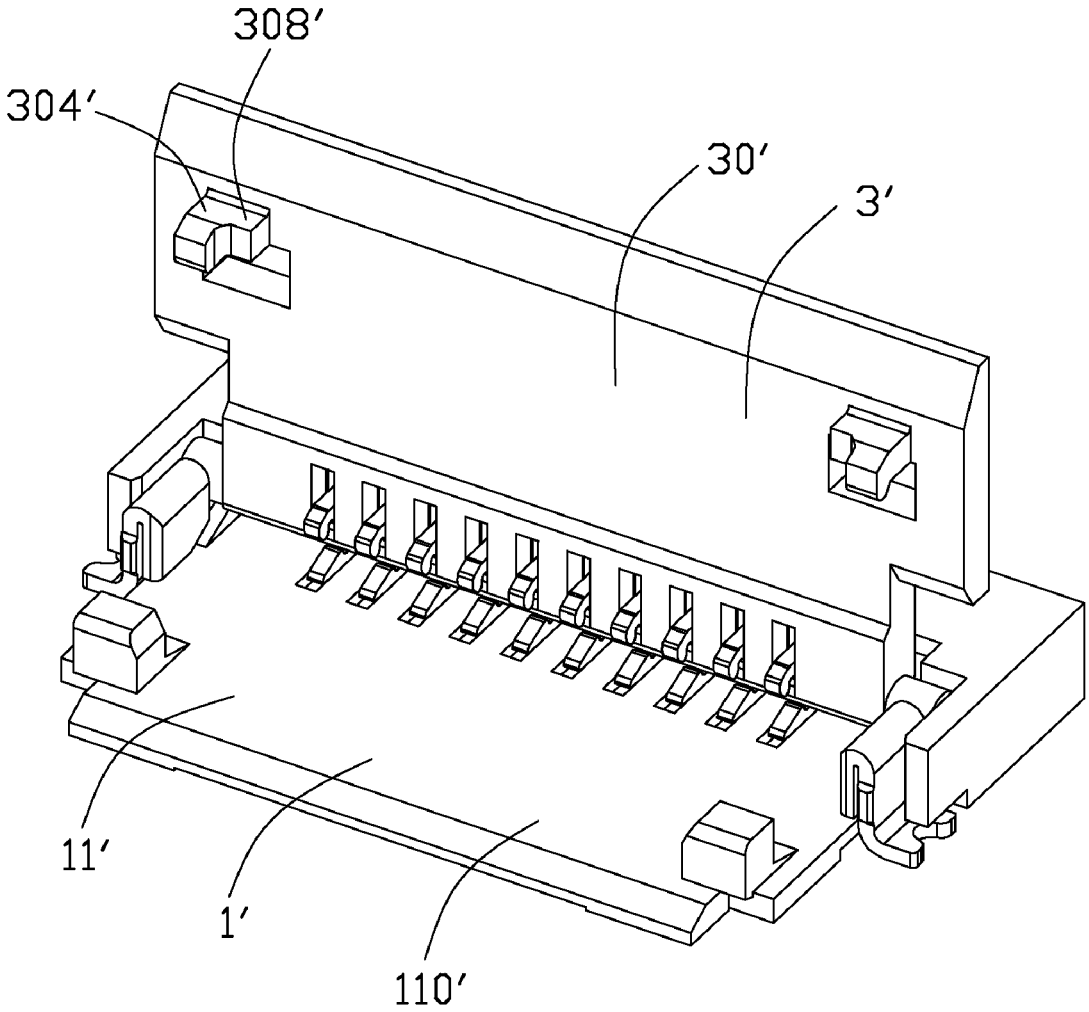
FIG. 6 is a perspective view of a second embodiment of the electrical connector in accordance with the present invention, in which the actuator is at an opened position.
Figure 7:
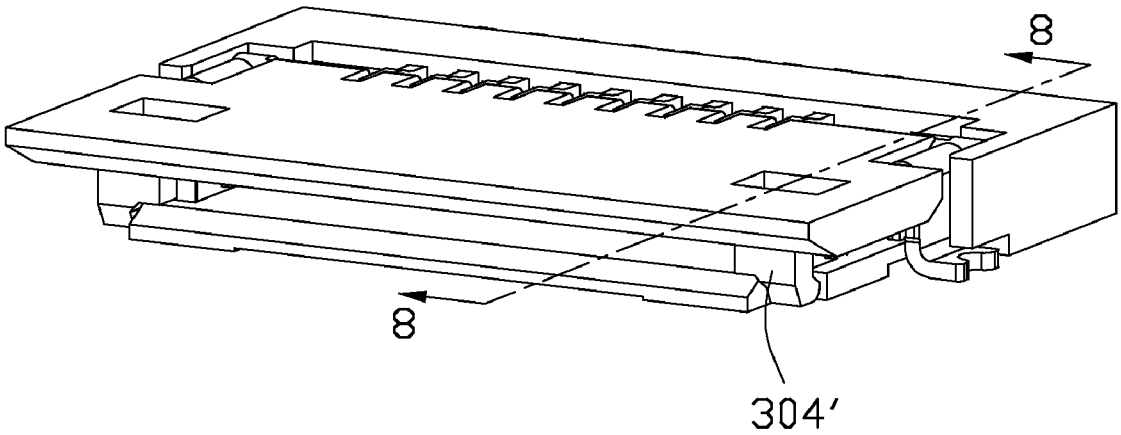
FIG. 7 is another perspective view of the electrical connector shown in FIG. 6, in which the actuator is at a closed position.
Figure 8:
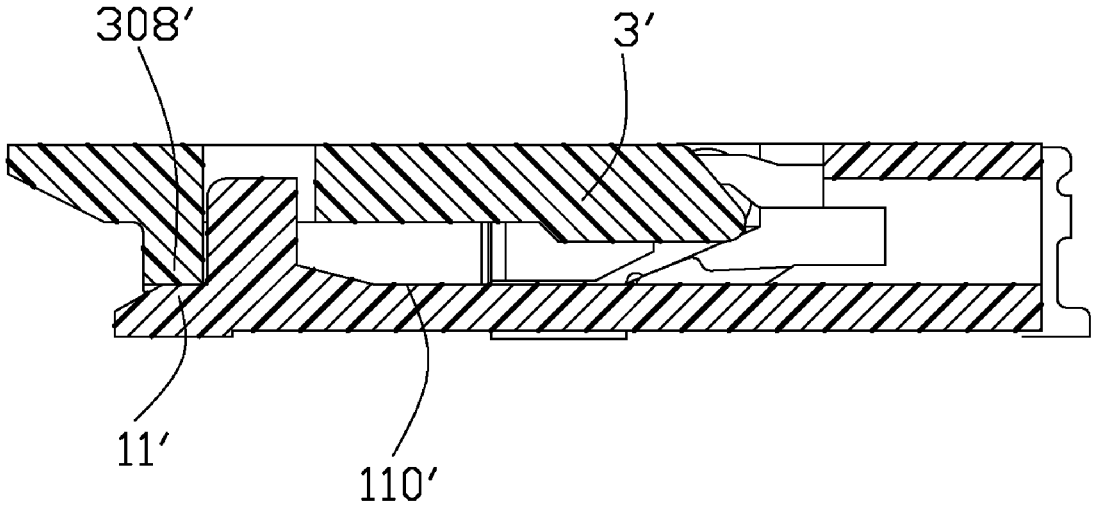
FIG. 8 is a cross-sectional view of the electrical connector shown in FIG. 7 along line 8-8.

FIG. 6 to FIG. 8 show a second embodiment of the electrical connector in accordance with the present invention. The electrical connector has a similar configuration as the electrical connector of the first embodiment and further comprises a pair of supporting portions 308' each of which protrudes downwardly from the base portion 30' of the actuator 3' and locates at a lateral side of the locking beams 304'. The supporting portions 308' are shorter than the locking beams 304' so that each supporting portion 308' stands on the top face 110' of the bottom wall 11' when the actuator 3' is closed. The supporting portions 308' can be also arranged apart from the locking beams 304'. The supporting portions 308' stand on the bottom wall 11' for preventing the actuator 3' from dropping overly.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for connecting a flexible printed circuit board comprising:

an insulator defining a cavity for receiving an end of the flexible printed circuit board and having a bottom wall below the cavity;

a plurality of terminals disposed in the insulator and arranged alternately along the cavity of the insulator, each terminal having a contact beam protruding into the cavity and a pivot beam arranged opposite to the contact beam; and an actuator having a plurality of shafts pivotally cooperating with the pivot beams of the terminals;

wherein the bottom wall has a post protruding towards a through hole on the actuator and locked by a locking beam formed on the actuator.

2. The electrical connector as described in claim 1, further comprising a pair of metal pads inserted into two ends of the insulator respectively, and each pad has a main body and an arm extending from the main body to be inserted in the insulator, the actuator has a pair of pivots supported by the arms of the pads respectively.

3. The electrical connector as described in claim 1, wherein the actuator comprises at least a supporting portion for standing on the bottom wall of the insulator.

4. The electrical connector as described in claim 3, wherein the supporting portion is shorter than the locking beam.

5. The electrical connector as described in claim 1, wherein each pivot beam of the terminals has a concave portion for cooperating with corresponding shafts of the actuator.

6. An electrical connector for connecting a flexible printed circuit board comprising:

an insulator comprising a top wall, a bottom wall opposite to the top wall and a pair of side wall joining with the top wall and the bottom wall thereby defining a cavity therebetween;

a plurality of terminals arranged exposed into the cavity; and an actuator mounting onto the insulator and rotated between an opened position where the flexible printed circuit board can be inserted into the cavity and a closed position where the flexible printed circuit board can be depressed downward to abut against the terminals;

wherein a post protrudes from the bottom wall, the actuator defines a locking beam for locking with the post and a through hole for receiving the post when the actuator is located at the closed position.

7. The electrical connector as described in claim 6, further comprising a supporting portion standing on the bottom wall when the actuator is at the closed position.

8. The electrical connector as described in claim 6, further comprising a pair of metal pads inserted into two ends of the insulator respectively, and each pad has a main body and an arm extending from the main body and inserted into the insulator, the actuator has a pair of pivots supporting by the arms of the pads respectively.

9. The electrical connector as described in claim 6, wherein each of the terminals having a holding portion held in the insulator, a contact beam protruding into the cavity and a pivot beam extending opposite to the contact beam, the actuator has a plurality of shafts mating with the pivot beams.

10. The electrical connector as described in claim 9, wherein each pivot beam has a concave portion receiving one shaft of the actuator.

11. An electrical connector assembly comprising:

an insulative housing defining a cavity;

a plurality of contacts disposed in the housing with contacting sections exposed in the cavity;

a flexible printed circuit (FPC) defining a contact end received in the cavity and mechanically and electrically connecting to the contacts, said FPC further defining at least one through hole; and an actuator pivotally mounted to the housing and covering the cavity to cooperate with the housing to sandwich the FPC therebetween; wherein at least one of the housing and the actuator defines a post extending through the through hole toward the other, and an interlocking mechanism located proximate said post and said through hole fastens the actuator to the housing.

12. The electrical connector assembly as claimed in claim 11, wherein said post extends from the housing toward the actuator.

13. The electrical connector assembly as claimed in claim 12, wherein said actuator includes a recess to receive said post therein.

14. The electrical connector assembly as claimed in claim 12, wherein said interlocking mechanism includes a locking beam unitarily extending from the actuator with a hook, at a distal end, into the through hole to lock to the post.

15. The electrical connector assembly as claimed in claim 14, wherein the through hole is dimensioned large enough to receive both the post and the locking beam therein.

16. The electrical connector assembly as claimed in claim 12, wherein said actuator includes another through to receive said post therein, said interlocking mechanism includes a locking beam unitarily extending from the actuator with a hook, at a distal end, into the through hole to lock to the post, and said hook is aligned with said another through hole in a vertical direction.

17. The electrical connector assembly as claimed in claim 16, wherein said through hole is dimension to large enough to receive both the post and the locking beam therein while said another through hole is smaller than said through hole and only receives the post therein.

* * * * *